United States Patent [19]

Wolf et al.

[11] Patent Number: 4,527,469

[45] Date of Patent: Jul. 9, 1985

[54] DOT MATRIX PRINT ACTUATOR

[75] Inventors: Peter H. Wolf, Thousand Oaks; David C. Clarke, Canyon Country; Heinz H. Hieber, Valencia, all of Calif.

[73] Assignee: Dataproducts Corporation, Woodland Hills, Calif.

[21] Appl. No.: 485,199

[22] Filed: Apr. 15, 1983

[51] Int. Cl.[3] ..... B41J 3/12

[52] U.S. Cl. ..... 101/93.04; 101/93.48; 400/121; 400/719

[58] Field of Search ..... 400/121, 124, 157.2, 400/719; 101/93.04, 93.05, 93.48, 93.34

[56] References Cited

U.S. PATENT DOCUMENTS

| | | | |
|---|---|---|---|
| 3,907,092 | 9/1975 | Kwan et al. | 400/124 |
| 4,033,255 | 7/1977 | Kleist et al. | 101/93.04 |
| 4,258,623 | 3/1981 | Barrus et al. | 101/93.48 X |
| 4,273,039 | 6/1981 | Luo et al. | 400/124 X |
| 4,351,235 | 9/1982 | Bringhurst | 101/93.04 |
| 4,359,937 | 11/1982 | Helinski | 101/93.04 |
| 4,423,675 | 1/1984 | Luo et al. | 101/93.48 X |
| 4,433,927 | 2/1984 | Cavallari | 400/124 |

FOREIGN PATENT DOCUMENTS

| | | | |
|---|---|---|---|
| 27376 | 3/1981 | Japan | 101/93.04 |
| 22072 | 2/1982 | Japan | 400/719 |

OTHER PUBLICATIONS

*IBM Tech. Disc. Bulletin*, by H. D. Chai, vol. 24, No. 4, Sep. 1981, p. 2133.

*Primary Examiner*—Paul T. Sewell

*Attorney, Agent, or Firm*—Spensley Horn Jubas & Lubitz

[57] ABSTRACT

An actuator assembly for a dot matrix printer of the stored energy type in which a plurality of flexible spring hammer elements are mounted in an interleaved arrangement in order to provide a compact structure. The actuator assembly includes a mounting block having upper and lower magnetic circuits and spring hammers attached to it. A portion of the magnetic circuits is coupled to the rear of the mounting block in order to facilitate heat dissipation from the actuator. The pole pieces of the magnetic circuits are positioned to reduce resonance of the spring hammers to thereby decrease cycling time. Permanent magnets utilized in the assembly are arranged in a non-symmetrical fashion in order to increase the magnetic efficiency of the device. Integrally connected pole pieces and permanent magnets are used in the assembly to reduce manufacturing costs without degrading performance.

3 Claims, 9 Drawing Figures

Fig. 3
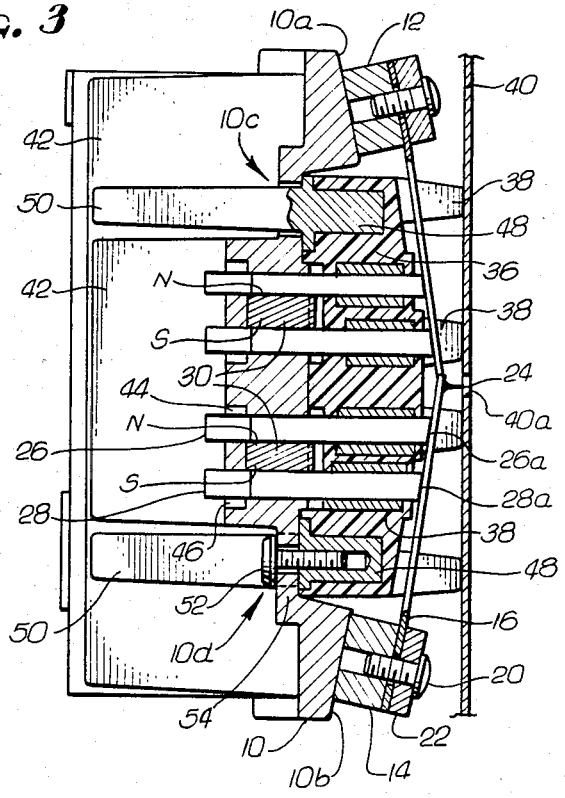
Fig. 5a
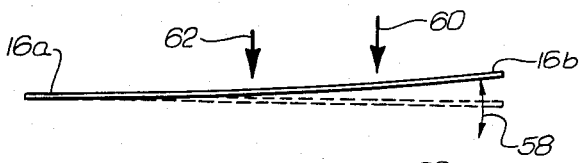
Fig. 5b
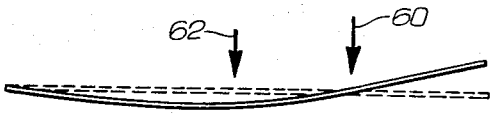
Fig. 5c
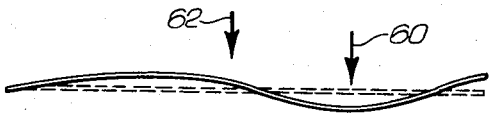
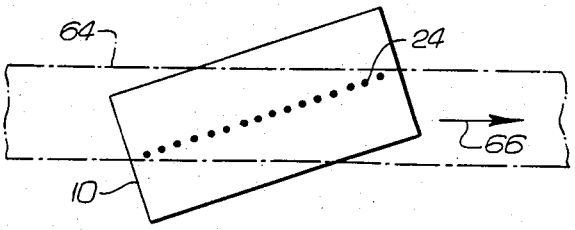
Fig. 7

DOT MATRIX PRINT ACTUATOR

BACKGROUND OF THE INVENTION

1. Field of the Invention

This invention relates to printing devices of the "stored energy" type in which a flexible hammer element carrying an impact tip is flexed to a cocked position by means of a permanent magnet. A coil is employed to generate an electromagnetic field which overcomes the magnetic field of the permanent magnet thereby releasing the hammer element and enabling it to fly forward toward an impact position. More particularly, the present invention is directed to a dot matrix actuator in which a plurality of hammer elements are employed to print dots to form characters. Still more particularly, the present invention relates to a dot matrix actuator in which flat spring magnetic hammer elements are employed in connection with a magnetic circuit containing at least one pole element, a permanent magnet coupled to the pole element and a coil surrounding the pole element.

2. Description of the Prior Art

Stored energy type print actuators are well known in the art. Actuators of this type are disclosed in the following U.S. Pat. Nos. 3,804,009 to Blume; 3,842,737 to Gomi; 3,941,051 to Barrus, et al.; 4,033,255 to Kleist, et al.; 4,044,668 to Barrus, et al.; 4,233,894 to Barrus, et al.; 4,258,623 to Barrus, et al.; and 4,280,404 to Barrus, et al. The '894 and '623 patents to Barrus, et al. disclose print hammer mechanisms which incorporate dual pole pieces. In both of these patents, when the spring hammer is in the retracted position, it contacts only one of the poles and a gap is maintained with the second pole. The gap is employed to improve the hammer release and retract capabilities.

All of the above patents disclose a print mechanism having a single row of printing elements whose impact tips are arranged along a print line. Printing is accomplished by successively printing rows of the character matrix and advancing the printing medium between the printing of each row of dots. This printing technique places several demands upon the precision of the shuttle mechanism which moves the actuators.

Dot matrix printers have been developed in which printing elements are arranged vertically so that an entire character is printed with each pass of the actuator. Such systems are disclosed in U.S. Pat. Nos. 3,999,644 to Pape, et al.; 4,136,978 to Bellinger, Jr., et al.; and 4,278,020 to Oaten. In the Pape and Oaten patents, the actuators are arranged so that the impact points lie along a line which is slanted with respect to the printing line. Neither of those patents is directed to a stored energy type actuator.

SUMMARY OF THE INVENTION

The present invention is directed to an improved actuator of the stored energy type. The actuator assembly incorporates numerous features which improve the performance and efficiency of the mechanism. Broadly, the actuator incorporates upper and lower sets of hammer elements and corresponding magnetic circuits with the free ends of the hammer elements being interleaved so that the impact tips of both the upper and lower sets lie along a common print line. The interleaved structure reduces interaction between the magnetic circuits of adjacent printing positions while at the same time providing a compact structure.

In operation, the printhead is carried so that the impact tips lie along a line which is slanted with respect to the printing line. An entire character is printed with each pass of the printhead, thereby avoiding any problems of misregistration between different rows of the matrix.

In another aspect of the invention, each magnetic circuit includes a pair of pole elements which are positioned so that their faces contact the hammer element when the hammer is retracted. This construction serves to aid in the damping of the hammer elements to thereby enable faster cycling times to be achieved. More specifically, the pole pieces are positioned so that they contact the hammer at points corresponding to anti-nodes of various modes of vibration of the hammer. The pole pieces thus provide physical obstructions which prevent the hammer from vibrating.

In accordance with another aspect of the invention, the spring hammer elements are angled with respect to the pole pieces and mounting assembly so that the impact tips extend beyond any other portion of the assembly. This structure facilitates convenient paper and ribbon motion.

In accordance with yet another aspect of the invention, the pole pieces are formed of a plurality of laminations and are connected to a common member. This structure increases the efficiency of the magnetic circuits by reducing eddy currents.

In accordance with yet another aspect of the invention, a cooling structure is formed integrally with the coil means.

BRIEF DESCRIPTION OF THE DRAWINGS

The invention will now be described with reference to the accompanying drawings, wherein:

FIG. 3 is a side sectional view of the actuator;

FIGS. 5*a*, 5*b*, and 5*c* are diagramatic illustrations of a spring hammer element showing the vibrational characteristics thereof;

FIG. 7 is a diagramatic view illustrating the orientation of the actuator assembly with respect to a printing line.

DESCRIPTION OF THE PREFERRED EMBODIMENT

The following description is of the best presently contemplated mode of carrying out the invention. This description is made for the purpose of illustrating the general principles of the invention and is not to be taken in a limiting sense. The scope of the invention is best determined by the appended claims.

Figure 1:
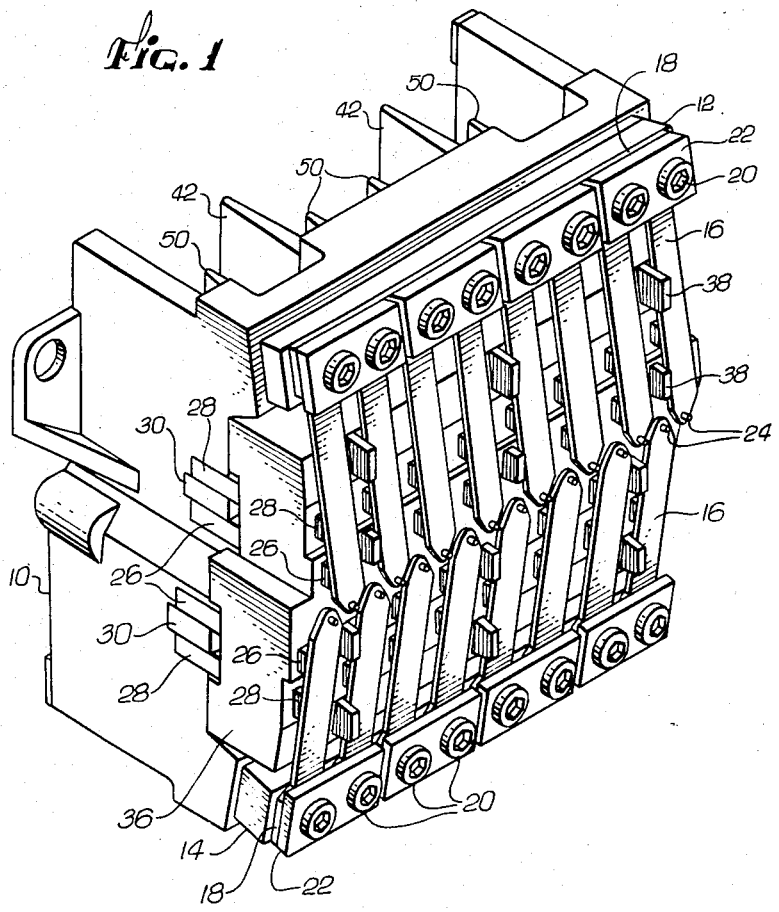
FIG. 1 is a perspective view of the printing actuator of the present invention.
Figure 2:
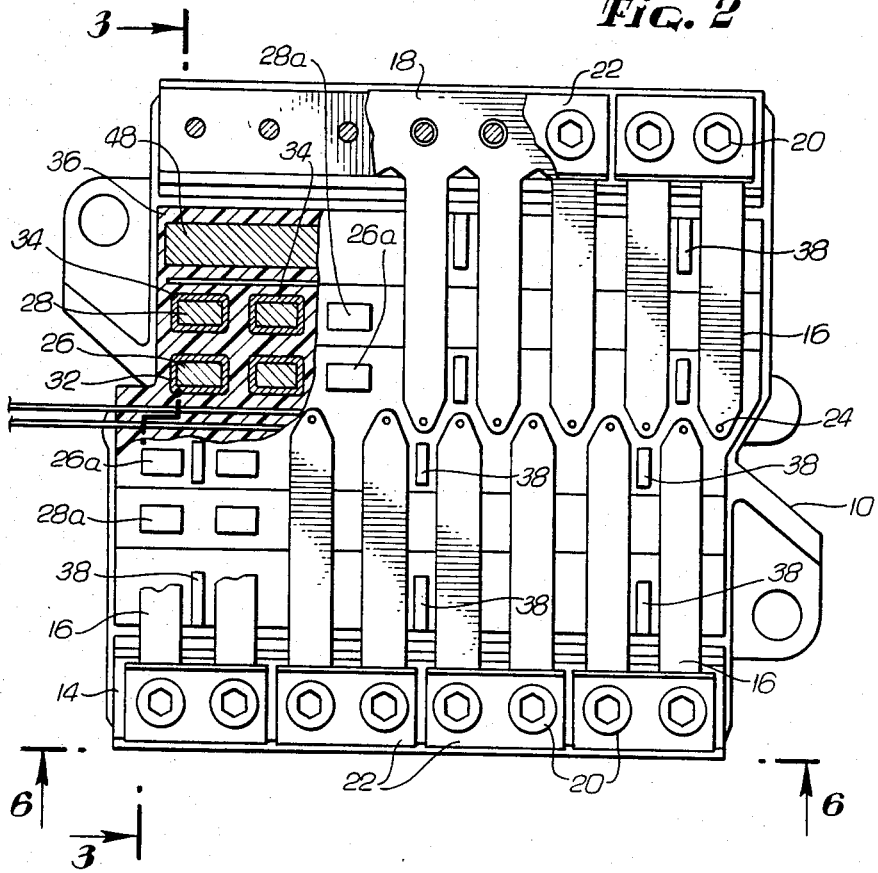
FIG. 2 is a front plan view, partially in section, of the actuator.

Referring to FIGS. 1, 2 and 3, the printhead of the present invention includes a mounting block 10 which is formed of cast aluminum or other heat conductive material. The mounting block includes upper and lower hammer mounting surfaces 10*a* and 10*b* and upper and lower magnetic circuit mounting surfaces 10*c* and 10*d*.

Mounting bars 12 and 14 are secured to the hammer mounting surfaces 10*a* and 10*b*, respectively. These mounting bars are preferably formed of hard tool steel in order to provide a rigid mounting surface.

A plurality of magnetic flat spring hammer elements 16 are integral with a common element 18. In the present embodiment of the invention, the hammer elements are formed of steel. The comb-like structure of the flat spring hammer elements 16 and the common element 18 is secured to the mounting bar 12 by means of a plurality of screws 20 and hard tool steel clamps 22. A second group of hammers is secured to the lower mounting bar 14. Each hammer has an impact tip 24 secured to the free end thereof. The impact tips are formed of carbide or some other hard material in order to provide good wear resistance. The hammer elements attached to the upper and lower mounting bars 12 and 14 are interleaved with each other so that the impact tips 24 of the two groups of hammers lie along a single line. In order to facilitate close spacing between the impact tips, the ends of the hammer elements are tapered.

As can be seen most clearly in FIG. 3, upper and lower magnetic circuits are secured to the mounting block 10 at the mounting surfaces 10*c* and 10*d*, respectively. Each magnetic circuit includes a first pole piece 26 and a second pole piece 28. A permanent magnet 30 is sandwiched between the pole pieces 26 and 28 near the rear portions thereof. The permanent magnet creates a magnetic field which causes the hammer 16 to flex inward and contact the faces 26*a* and 28*a* of the pole pieces. In the preferred embodiment of the invention, the hammers 16 are angled outwardly from the mounting block so that the impact tips 24 extend beyond the mounting structure, including the screws 20 and clamps 22. This configuration facilitates simplified paper feeding, since the paper may be moved past the printing position along a straight path. Since the hammers 16 are not perpendicular to the pole pieces, the pole faces are angled so that the hammer lies flat against them. The slanted pole faces have the additional advantage of presenting a greater surface area to the hammers than would be the case with a straight pole face. The increased surface contact between the pole faces and the hammer results in a decrease in wear in the pole faces and also improves the magnetic operation of the circuit. By angling the hammers, it is possible to place the pole 26 nearer the end of the hammer and increase the distance between the poles at the pole faces while maintaining the desired distance between the poles at the permanent magnet. Thus, the angling of the hammers increases the design flexibility of the magnetic circuit.

Surrounding the pole pieces 26 and 28 are coils 32 and 34, respectively. The coils are pulsed to generate an electromagnetic field which overcomes the magnetic field of the permanent magnet to release the hammer from its flexed position and allow it to fly forward to impact a ribbon and paper. In the present embodiment of the invention, the coils are connected in series in order to maximize the number of ampere-turns for the magnetic circuit. The series connection reduces current requirements for the magnetic circuit as compared to a parallel connection, although it does result in a somewhat increased inductance and slower current rise time.

As can be seen in FIGS. 2 and 3, the coils 32 and 34 are encapsulated in a molded epoxy member 36. The entire coil assembly is thus easily removed and replaced in the event of a malfunction. In addition to encapsulating the coils, the epoxy structure includes a number of integrally molded extensions 38 which provide a mounting surface for a ribbon shield 40 (shown only in FIG. 3). The shield includes a number of central openings 40*a* through which the impact tips of the hammers can pass when printing. The remainder of the actuator assembly is isolated from the ribbon and paper.

The upper and lower magnetic circuits of the actuator are arranged symmetrically with respect to each other with the exception of the permanent magnets 30. It has been found that by arranging the magnets in a non-symmetric fashion, i.e., with similar poles of the magnets facing in the same direction as indicated in FIG. 3, the interaction between the upper and lower magnetic circuits is reduced. That is, the magnetic flux provided in each magnetic circuit is maximized by arranging the magnets of the upper and lower circuits non-symmetrically. This increase in magnetic flux enables the use of hammers having a higher spring force than would otherwise be possible, thereby resulting in faster cycling of the hammers.

In addition to the non-symmetric orientation of the permanent magnets, the operation of the magnetic circuits is improved by having the rear ends of the pole pieces 26 and 28 extend beyond the rear surface of the permanent magnets. This provides a shunt path for the magnetic circuit which shifts the load characteristics of the permanent magnet so that it operates at a more optimum point on its BH curve. By providing the shunt path, the operation of the magnetic circuit may be controlled so that the flux density in the hammers is maximized for a given magnet size.

Figure 6:
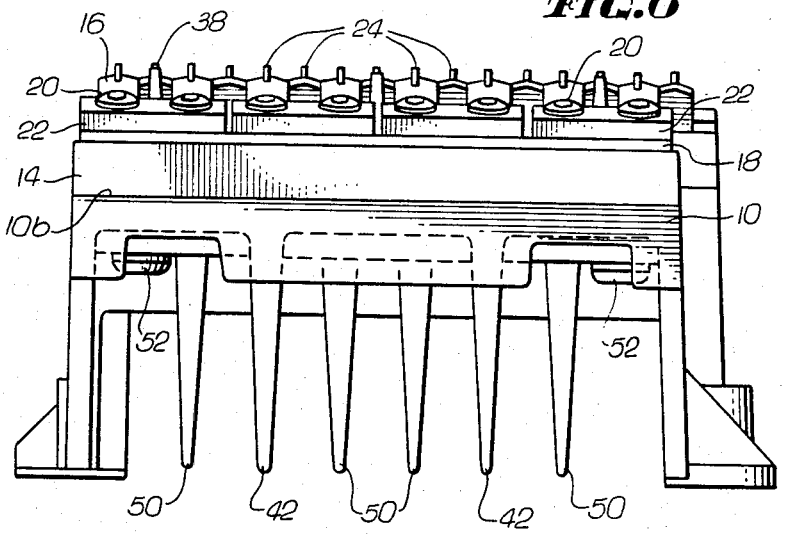
FIG. 6 is a bottom plan view of the actuator assembly showing heat sink elements extending to the rear of the assembly.

In achieving a high density actuator assembly, severe problems of heat generation are encountered. The present invention includes several features which help to aid in the dissipation of heat from the coils 32 and 34. As can be seen in FIGS. 1 and 6, the mounting block 10 includes a solid front portion to which the magnetic circuits are mounted and a plurality of vertically oriented fins 42 which extend to the rear of the assembly. The mounting block is formed of aluminum and serves to conduct heat away from the magnetic circuit assemblies. In the preferred embodiment of the invention, air is forced up past the cooling fins by means of a blower (not shown).

In addition to the finned structure of the device, several other features are employed to aid in the heat dissipation from the actuator. The mounting surfaces 10*c* and 10*d* include holes 44 and 46 which pass through the mounting block. The pole pieces 26 and 28 extend completely through the holes 44 and 46, respectively so that their ends extend into the air flow path adjacent the cooling fins. The pole pieces will thus be directly cooled by the forced air. This structure also provides the desired shunt path in the magnet circuit as described above.

In order to directly cool the coil assembly, two aluminum heat sinks 48 with fins 50 are molded into the epoxy 36. A number of such fins 50 may be provided along the width of the actuator assembly. The coil assembly is then secured to the mounting block with two screws 52 passing thru openings 54 in the mounting block. Heat generated in the coil assembly will be conducted by means of the heat sink 48 to the fins 50 where the heat will be dissipated by means of the forced air cooling. Thus, although there is no direct forced air cooling for the magnetic circuits, heat generated by the circuits is effectively dissipated by providing several heat conductive paths to the rear of the mounting block.

Figure 4:
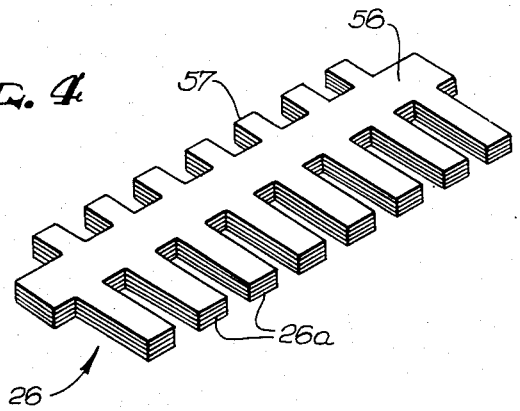
FIG. 4 is a perspective view of one of four multiple pole pieces used in the actuator.

Referring now to FIG. 4, in the preferred embodiment of the invention the pole pieces 26 of each magnetic circuit are connected to a common member 56 so as to form a comb-like structure. Similarly, the pole pieces 28 of the upper and lower magnetic circuits are connected together. By forming the pole pieces as a common element, the construction of the actuator is greatly simplified. This structure is to be contrasted with prior art structures in which individual pole pieces must be assembled into the actuator. It has been found that the provision of a common element for the pole pieces does not interfere with the operation of the magnetic circuits, so that the manufacturing benefit of providing a common element can be realized without degrading the performance of the actuator. In order to increase heat dissipation as discussed above, a plurality of extensions 57 extend from the rear of the common member 56 through holes in the mounting block.

In addition to connecting the pole pieces together, in the present invention the pole pieces are formed of a plurality of laminations rather than from a solid piece of material. This provides the manufacturing benefit of enabling the pole pieces to be stamped out from thin sheets of metal. More importantly, the laminations substantially improve the efficiency of the actuator. By making the pole pieces laminated, the generation of eddy currents within the pole pieces is greatly reduced. The eddy currents oppose the magnetic field created in the pole pieces by the coils, and by minimizing them the amount of current required to overcome the permanent magnetic field is reduced. This in turn reduces the amount of heat generated in the actuator assembly.

Although individual permanent magnets could be used for each magnetic circuit in the actuator assembly, it has been found that a common permanent magnet can be employed without any degradation in performance. Although the performance of the system is essentially the same whether individual permanent magnets are utilized or a single magnet is utilized, it is much simpler from a construction standpoint to employ a single permanent magnet. Therefore, a substantial cost savings can be realized by employing a common permanent magnet for each of the two groups of magnetic circuits.

Referring now to FIGS. 5*a*, 5*b* and 5*c*, the positioning of the pole faces 26*a* and 28*a* with respect to the hammer elements 16 is an important design feature of the present invention. In order to decrease the cycling time and thus increase the operating speed of the actuator, the motion of a spring hammer must be damped as quickly as possible after each impact. The pole pieces are used to aid in the damping operation. FIG. 5*a* illustrates the fundamental mode of vibration of a spring hammer 16. The hammer is fixed at an end 16*a* and the free end 16*b* will vibrate after impact as indicated by an arrow 58. This mode of vibration can be damped by locating a pole piece near the free end of the hammer. Thus, the pole piece 26, the position of which is indicated by an arrow 60, will serve to damp the fundamental mode of vibration of the hammer.

The secondary mode of vibration of the hammer is indicated (in exaggerated fashion) in FIG. 5*b*. It can be seen that the pole piece 26 is located near a vibrational node and will thus be relatively ineffective in damping out this second mode of vibration. However, the pole piece 28 is located so that it is adjacent an anti-node of the second mode of vibration of the hammer, as indicated by an arrow 62. By locating the pole piece 28 adjacent the point of maximum excursion in the second mode of vibration, and by positioning the pole piece 28 so that the pole face contacts the hammer in its retracted position, the second mode of vibration will be damped.

FIG. 5*c* illustrates the third mode of vibration of a hammer element 16. In this figure, it can be seen that the position of the pole piece 26 as indicated by arrow 60 corresponds to a point of maximum excursion (anti-node) of the hammer in the third mode of vibration. This pole will therefore serve to damp out the third mode of vibration. Thus, by accurately positioning the pole pieces with respect to the spring hammer after having determined the vibrational characteristics of the hammer, the resonances of the hammer can be greatly reduced. Hammer vibration will therefore be quickly damped and the cycling time of the actuator is improved.

Referring now to FIG. 7, a print line is indicated at 64. When installed in a printer mechanism, the actuator assembly of the present invention is attached to a shuttle mechanism which traverses the print line. The actuator tilted so that the impact tips 24 extend from top to bottom of the print line 64. In order to print, the actuator is moved in a direction indicated by an arrow 66 and the impact tips are actuated at a predetermined time in order to form dot matrix characters. An entire character line is thus printed with each pass of the actuator. This is to be contrasted with prior actuators in which each row of the character matrix is printed individually. By tilting the printhead and printing an entire character with each pass of the head, the shuttle speed of the printhead may be reduced without reducing the overall printing speed. In addition, problems of misregistration between rows of the character matrix are substantially reduced. It should be noted that although the preferred method of operation for the actuator is in a tilted configuration, the actuator can also be used to print a single row of character dots at a time.

In summary, the present invention is directed to a print actuator having substantially improved performance over prior art designs. Although a specific embodiment of the invention has been described, various modifications and variations within the scope of the invention will be apparent to those skilled in the art.

What is claimed is:

1. A stored energy type dot matrix print actuator, comprising:

a mounting assembly;

a plurality of elongated flat spring hammer elements secured to the mounting assembly in a spaced apart parallel relationship, wherein each hammer element includes a portion which is flexible back and forth relative to the mounting assembly; and a plurality of magnetic circuits secured to the mounting assembly between the mounting assembly and the flexible portion of the hammer elements, each magnetic circuit including first and second spaced apart pole elements having pole faces which face a hammer element, a permanent magnet magnetically coupled to the pole elements to generate a magnetic field which flexes the hammer element toward the pole faces, and coil means for generating an electromagnetic field to overcome the magnetic field of the permanent magnet to thereby release the flexed hammer element, wherein the pole elements are positioned so that an associated hammer element contacts both pole faces when it is flexed to thereby reduce resonance of the hammer elements, wherein a first pole face is positioned near the free end of the associated hammer element to damp the fundamental mode of vibration of the hammer element, and a second pole face is positioned at a location corresponding to an anti-nodal point of the second mode of vibration of the hammer element to thereby damp said second mode of vibration.

2. An actuator assembly according to claim 1 wherein the first pole face is positioned at a location corresponding to an anti-nodal point of the third mode of vibration of the hammer element to thereby damp said third mode of vibration in addition to the first mode of vibration.

3. A stored energy type dot matrix actuator, comprising:

a mounting assembly having a front surface having an upper portion, lower portion and middle portion and a rear surface defining a cooling area;

a first plurality of elongated flat magnetic spring hammer elements secured at one end to the lower portion of the mounting assembly in a spaced apart parallel relationship, and a second plurality of elongated flat spring hammer elements secured at one end to the upper portion of the mounting assembly, wherein the first and second plurality of hammer elements extend toward each other and wherein the free ends of the first plurality of hammer elements are interleaved with the free ends of the second plurality of hammer elements and are flexible toward and away from the middle portion of the mounting assembly;

a first group of magnetic circuits secured to the middle portion of the frame assembly adjacent the first plurality of hammer elements and a second group of magnetic circuits secured to the middle portion of the frame assembly adjacent the second plurality of hammer elements, each magnetic circuit including first and second spaced apart parallel elongated pole pieces having pole faces which face a hammer element, permanent magnet means located between the pole pieces which creates a magnetic field which retracts the hammer element toward the pole faces, and coil means wrapped around each pole piece generating an electromagnetic field which overcomes the magnetic field of the permanent magnet means to thereby release the hammer element, wherein the pole pieces of the magnetic circuits include a portion which extends through the mounting assembly and into the cooling area; and heat conductive means, separate from the pole pieces, coupled to the coils of both the first and second groups of magnetic circuits, said heat conductive means passing through the mounting assembly to the rear surface thereof, whereby heat is conducted from the coil means to the rear surface of the mounting assembly away from the hammer elements and magnetic circuits.

* * * * *